United States Patent [19]

Lynch

[11] 4,429,459

[45] Feb. 7, 1984

[54] ELECTRICAL TERMINAL WITH CAVITY COMPENSATOR

[75] Inventor: James E. Lynch, Harrisburg, Pa.

[73] Assignee: AMP Incorporated, Harrisburg, Pa.

[21] Appl. No.: 274,607

[22] Filed: Jun. 17, 1981

[51] Int. Cl.[3] ..... H01R 4/48

[52] U.S. Cl. ..... 29/881; 29/884

[58] Field of Search ..... 339/17 C, 217 R, 217 S, 339/221 R, 221 M, 276 SF, 276 A; 29/881, 882, 884

[56] References Cited

U.S. PATENT DOCUMENTS

| | | | |
|---|---|---|---|
| 3,146,051 | 8/1964 | Woofter et al. | 339/217 S |
| 3,761,871 | 9/1973 | Christianus . | |
| 3,789,343 | 1/1974 | Hirokawa et al. | 339/217 S |
| 3,923,365 | 12/1975 | Lynch . | |

FOREIGN PATENT DOCUMENTS

| | | | |
|---|---|---|---|
| 2249258 | 4/1973 | Fed. Rep. of Germany | 339/276 A |

OTHER PUBLICATIONS

AMP Economate: Components Featuring Action Pin Contacts (Sep. 1979) Brochure 75-316.

*Primary Examiner*—Eugene F. Desmond
*Assistant Examiner*—David Pirlot
*Attorney, Agent, or Firm*—Allan B. Osborne

[57] ABSTRACT

A compliant terminal pin for use in electrical connectors for housings or circuit boards and the like which is press fitted into position and is retained in the connector housing, printed circuit board or the like by means of a friction fit. The terminal includes a rigid post at one end and a resilient spring contact structure at the other end thereof. The contact structure and the post are joined by an intermediate section having an aperture therethrough and a lance or tyne extending outwardly from the bottom of the aperture, the tyne being fittable into the aperture but being of smaller dimension. The intermediate section is a spring member having tapered sides with the narrow portion of the taper extending toward the post. The intermediate section can move inwardly from both sides by spring type action to occupy a portion of the aperture, thereby decreasing the dimension across the intermediate section. Upon insertion into a connector for a housing or printed circuit board or the like, the tyne will push against a housing wall and move the terminal against an opposite housing wall as the terminal enters an appropriate housing cavity. As the terminal moves farther into the cavity, the tapered portion will move against the other pair of opposing cavity walls and force the sides of the intermediate section together, thereby preventing the tyne from moving into the aperture and providing a friction fit within the housing cavity at the tyne as well as both sides of the intermediate section.

3 Claims, 5 Drawing Figures

ELECTRICAL TERMINAL WITH CAVITY COMPENSATOR

This invention relates generally to terminals for electrical connectors which are mountable in cavities in housings or circuit boards and, more particularly, to that portion of the terminal or pin which engages the walls of apertures formed therefor in housings or circuit boards.

It is common practice to force fit pins or terminals such as terminal posts into cavities in electrical connector housings, printed circuit boards or the like. Such force fitted terminals have portions which are designed to effect a friction fit against the walls forming the cavities in the housings or circuit boards. The friction fit is desirable, even in the cases where the terminal is to be later soldered, to provide a circuit board engaging means which has entry and withdrawal forces within predetermined limits and which will hold a terminal rigidly in an cavity with a minimum of wobble or misalignment until the soldering can take place.

The foregoing characteristics of uniform entry and withdrawal forces of the terminals are inserted in a circuit board simultaneously wherein the terminals are secured to a common carrier strip. When the terminals are to be soldered, the carrier strip is sometimes broken off after the insertion of the terminals and before soldering occurs. In such cases, if one of the terminals fits too loosely in its hole, it can easily become misaligned or, in certain extreme cases, can slip out of the hole. When the terminals fit within the cavities too tightly, enough pressure can build up on the printed circuit board housing or connector housing to break the plastic housing.

This problem has been recognized as shown in the patent to Lynch (U.S. Pat. No. 3,923,365) which discloses a press fitted terminal post wherein the terminal post has an engaging portion for engaging the walls of a cavity formed in a housing or a printed circuit board in which the cavity is substantially rectangular in cross-sectional area configuration. The engaging portion comprises a pair of curved, substantially parallel beams extending longitudinally through the cavity. The two beams are curved in the same direction with two ends of the concave sides of the beam pressing against one major wall of the cavity and the center portion of the convex beam pressing against the other major wall of the cavity. The two beams are bowed outwardly from each other with their side edges pressing against the side walls of the cavities, thereby producing an overall force-fit effect in which the cavity engaging portion of the terminal exerts force in all four directions against the side walls of the cavities and is rigidly secured therein.

While this arrangement has performed its function well in the field, it has applied a tension to the housing or printed circuit board at the points of friction fit and has, on occasion, caused a rupture of the housing and/or printed circuit board. In accordance with the present invention, the force applied by the terminal to the plastic housing, places the plastic material in compression rather than in tension, thereby taking advantage of the plastic material properties since plastic in compression is much stronger than plastic in tension.

The above is accomplished by providing a compliant terminal for use in electrical connectors for housings or printed circuit boards and the like which is press fitted into position and is retained in the connector housing, printed circuit board or the like by means of a friction fit. The terminal includes a rigid post at one end and a resilient spring contact at the other end thereof. The contact and the post are joined by an intermediate section having an aperture therethrough and a lance or tyne extending outwardly from the pin at the bottom of the aperture, the tyne being fittable into the aperture but being of smaller diameter. The intermediate section is a spring member having tapered sides with the narrow portion of the taper extending toward the post. The intermediate section can move inwardly from both sides by spring type action to occupy a portion of the aperture, thereby decreasing the dimension across the intermediate section. Upon insertion into a connector for a housing or printed circuit board or the like, the tyne will push against a housing wall and move the terminal against an opposite housing wall as the terminal enters an appropriate housing cavity. As the terminal moves farther into the cavity, the tapered portion will move against the other pair of opposing cavity walls and force the end portions of the intermediate sections together, thereby preventing the tyne from moving into the aperture and providing a friction fit within the housing cavity at the tyne as well as both sides of the intermediate section.

Figure 1:
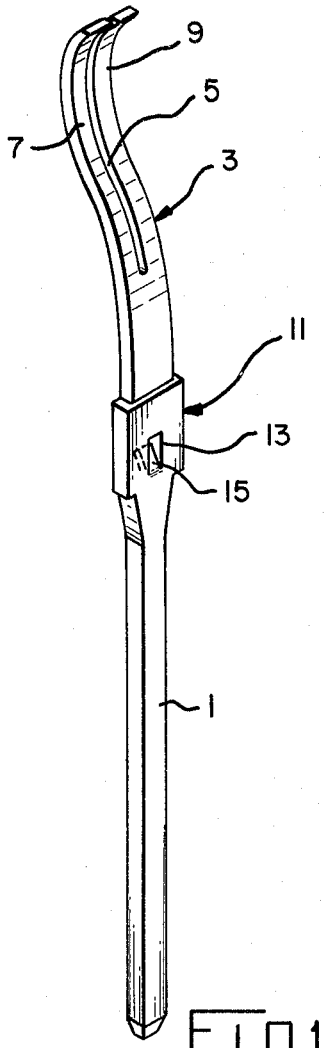
FIG. 1 is an elevational view of a terminal for insertion in electrical connector housings and the like accordance with the prior art.

Referring first to FIG. 1, there is shown a prior art terminal. This terminal includes a post 1, a contact area 3 having a slot 5 positioned between the bifurcated spring contact fingers 7 and 9. An intermediate rectangular region 11 is provided having an aperture 13 therethrough and a tyne 15 which is the same shape as and cut from the aperture 13. The section 11 is relatively rigid and does not provide spring like properties. Accordingly, the tyne or lance 15, which impinges against one side wall of a cavity in a housing, will have a tendency to move into the aperture 13. If the force provided against the housing cavity wall is insufficient, the terminal can therefore move in the cavity or actually fall out of the housing.

Figure 2:
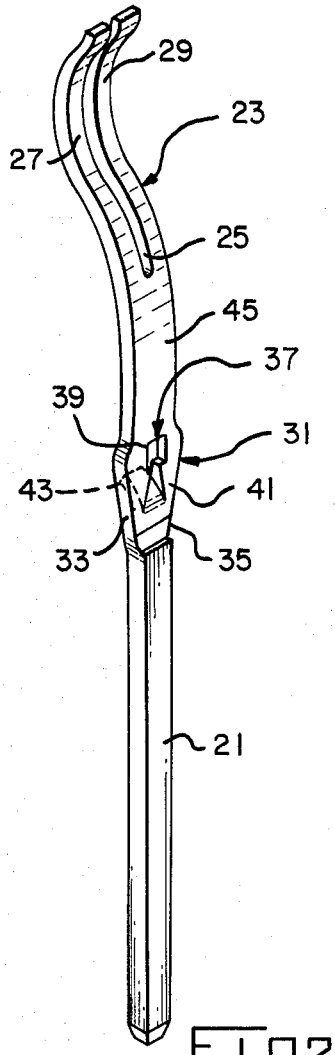
FIG. 2 is an elevational view of a terminal in accordance with the present invention.
Figure 3:
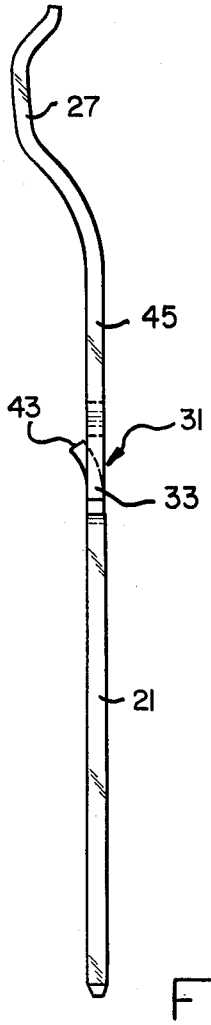
FIG.3 PRIOR ART
FIG. 3 is a side view of the terminal of FIG. 2.

Referring now to FIGS. 2 and 3, there is shown a terminal for electrical connectors in accordance with the present invention. The terminal includes a post 21 and a bifurcated contact structure 23 having a slot 25 between spring contact fingers 27 and 29. Also the contact structure can be a single spring finger. An intermediate section 31 is provided coupling the post 21 and the contact structure 23. The intermediate section has tapered sides 33 and 35 with the narrow portion of the taper abutting the post 21. An aperture 37 is provided in the central portion of the intermediate section 31, the aperture 37 having a rectangularly shaped upper portion 39 and a trapezoidally shaped lower portion 41. A lance 43 is provided in the shape and size of the trapezoidal portion only. The intermediate section 31 is resilient, the sides 33 and 35 thereof being movable toward each other into the aperture 37.

In practice, though the terminals as shown in FIGS. 2 and 3 can be formed separately, they are normally formed in a strip of many terminals with a carrier strip (not shown) connecting the terminals together, usually by being connected to the terminal portions of the contact fingers 27 and 29. This is well known and described in the above mentioned patent.

Figure 4:
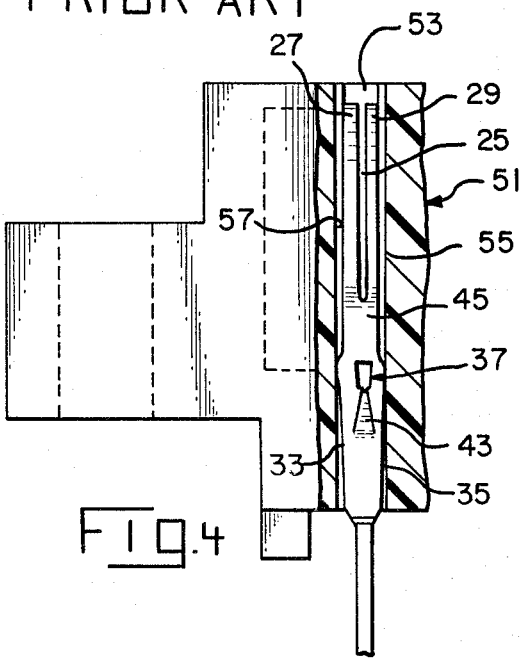
FIG. 4 is a cross-sectional view of a housing with the terminal in accordance with the present invention inserted therein.
Figure 5:
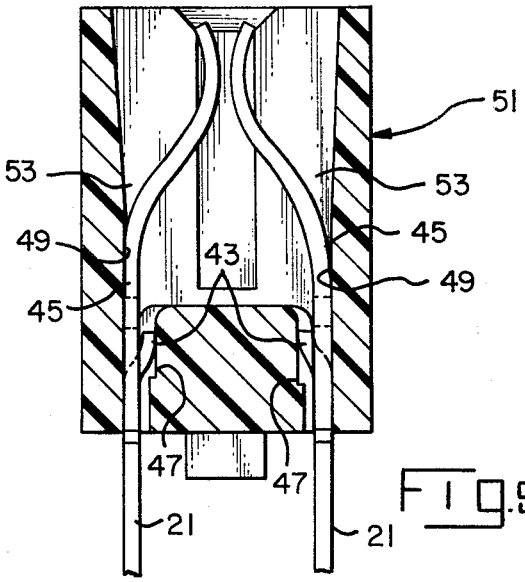
FIG. 5 is a cross-sectional view of a housing with a pair of terminals in accordance with the present invention inserted within a cavity therein.

In operation, the terminal of FIGS. 2 and 3 will be inserted into a cavity 53 in a connector housing 51 as shown in FIGS. 4 and 5, the lance 43 impinging against one side wall 47 and moving the terminal so that the side 45 of the terminal impinges against the opposite wall 49 of the cavity. It can be seen that the cavity side walls 55 and 57 impinging against the tapered sides 33 and 35 will compress those sides inwardly and into aperture 37. The compression will tend to lock lance 43 against its moving into aperture 37 of the terminal and thereby providing a strong frictional fit between the lance and the side wall on which it impinges. Further, the inwardly compressed tapered sides 33 and 35 attempt to recover to their original position against opposing cavity walls 55 and 57. Thus, a rigid frictional fit of the pin in the housing cavity is accomplished by locking the lance and by the residual forces in tapered sides 33 and 35.

As can be seen with reference to FIG. 5, a pair of opposing terminals can be provided in a single pair of cavities to receive a mating connector element therebetween.

Though the invention has been described with respect to a specific preferred embodiment thereof, many variations and modication will immediately become apparent to those skilled in the art. It is therefore the intention that the appended claims be interpreted as broadly as possible in view of the prior art to include all such variations and modifications.

I claim:

1. A method of fixing a terminal of the type having an intermediate section (31) between a post (21) and a contact structure (23) and an aperture (37) in the intermediate section (31) with a lance (43) extending outwardly therefrom into a housing (51), the method comprising the steps of:

a. providing the intermediate section (31) with tapered sides (33, 35) which are resilient into and away from the aperture (37);

b. inserting the terminal into the housing (51) with the narrowest end of the intermediate section (31) entering the cavity (53) first so that the lance (43) in encountering a wall (47) of the cavity (53) can be deflected towards the aperture (37) as required by the cavity dimension; and c. further inserting the terminal into the housing so that as the tapered sides (33, 35) of the intermediate section (31) encounter opposing walls (55–57) of the cavity (53), the tapered sides (33, 35) are compressed into the aperture (37) so that the aperture size is reduced and the lance (43) becomes locked against further movement towards the aperture (37).

2. The method as claimed in claim 1 further including the step of providing the aperture (37) and lance (43) with a trapezoidally shape.

3. The method as claimed in claim 2 further including the step of adding an upper portion (39) to the aperture (37).

* * * * *